US010811817B1

(12) United States Patent
Peterson et al.

(10) Patent No.: US 10,811,817 B1
(45) Date of Patent: Oct. 20, 2020

(54) WIRE DRESS COVER FOR AN ELECTRICAL CONNECTOR

(71) Applicant: TE CONNECTIVITY CORPORATION, Berwyn, PA (US)

(72) Inventors: Kevin John Peterson, Kernersville, NC (US); William John Remaley, East Bend, NC (US); Sameh Lotfy Mankaryos, Huntersville, NC (US); Paul David Roman, Jr., Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/449,628

(22) Filed: Jun. 24, 2019

(51) Int. Cl.
*H01R 13/58* (2006.01)
*H01R 13/502* (2006.01)
*H01R 4/20* (2006.01)

(52) U.S. Cl.
CPC ..... *H01R 13/58* (2013.01); *H01R 4/20* (2013.01); *H01R 13/502* (2013.01)

(58) Field of Classification Search
CPC ..... H01R 13/58; H01R 13/502; H01R 4/20
See application file for complete search history.

(56) References Cited

U.S. PATENT DOCUMENTS

| | | | | |
|---|---|---|---|---|
| 6,524,135 | B1 * | 2/2003 | Feldman | H01R 9/035 439/607.46 |
| 9,368,903 | B1 * | 6/2016 | Keep | H01R 13/5205 |
| 10,398,050 | B2 * | 8/2019 | Tracy | H05K 7/02 |
| 2019/0140384 | A1 * | 5/2019 | Miyoshi | H01R 13/506 |

* cited by examiner

*Primary Examiner* — Abdullah A Riyami
*Assistant Examiner* — Nader J Alhawamdeh

(57) ABSTRACT

An electrical connector includes a housing having a mating end and a wire end with a base and terminal channels extending through the base into the mating end. The terminal channels receive terminals mated with a mating electrical connector. The base has a wire support supporting wires extending from the terminals. The wire support includes support walls forming wire channels. A wire dress cover is coupled to the wire support and includes an end wall and wire pushers extending from the end wall. The wire pushers load the wires into the wire channels. The wire pushers are received in the wire channels to hold the wires in the wire channels. The wires are supported at the rear by the wire pushers and at both sides by the support walls to provide strain relief for the wires in the wire support.

19 Claims, 8 Drawing Sheets

WIRE DRESS COVER FOR AN ELECTRICAL CONNECTOR

BACKGROUND OF THE INVENTION

The subject matter herein relates generally to electrical connectors.

Electrical connectors are used for data communication in various systems, such as automotive vehicles. The electrical connectors include housings holding terminals. The terminals are provided at ends of wires. During assembly, the terminals are loaded into the housing and then the wires are dressed into wire channels in the housing. For example, the operator places each of the individual wires into the corresponding wire channel. However, the wire dressing process is time consuming, particularly with connectors having a high number of terminals and wires.

A need remains for an electrical connector that may be assembled in a cost effective and reliable manner.

BRIEF DESCRIPTION OF THE INVENTION

In an embodiment, an electrical connector is provided. The electrical connector includes a housing having a mating end at a front of the housing and a wire end at a rear of the housing. The housing has a base at the wire end. The housing has terminal channels extending through the base into the mating end. The terminal channels receive terminals configured to be mated with a mating electrical connector. The base has a wire support supporting wires extending from the terminals. The wire support includes support walls forming wire channels. The electrical connector includes a wire dress cover coupled to the wire support. The wire dress cover includes an end wall and wire pushers extending from the end wall. The wire pushers load the wires into the wire channels. The wire pushers are received in the wire channels to hold the wires in the wire channels. The wires are supported at the rear by the wire pushers and at both sides by the support walls to provide strain relief for the wires in the wire support.

In another embodiment, an electrical connector is provided. The electrical connector includes a housing having a mating end at a front of the housing and a wire end at a rear of the housing. The housing has a base at the wire end. The housing has terminal channels extending through the base into the mating end along terminal channel axes. The terminal channels receive terminals configured to be mated with a mating electrical connector. The base has a wire support supporting wires extending from the terminals. The wire support includes support walls forming wire channels. The electrical connector includes a wire dress cover slidably coupled to the wire support in a sliding direction generally perpendicular to the terminal channel axes. The wire dress cover is movable in the sliding direction from an uncoupled position to a coupled position. The wire dress cover includes an end wall and wire pushers extending from the end wall. The wire pushers extend parallel to the sliding direction. The wire pushers engage each of the wires and load each of the wires into the wire channels as the wire dress cover is moved from the uncoupled position to the coupled position. The wire pushers are received in the wire channels to hold the wires in the wire channels.

In a further embodiment, an electrical connector is provided. The electrical connector includes a housing having a mating end at a front of the housing and a wire end at a rear of the housing. The housing has a base at the wire end. The housing has terminal channels extending through the base into the mating end. The terminal channels receive terminals configured to be mated with a mating electrical connector. The base has a wire support supporting wires extending from the terminals. The wire support includes support walls forming wire channels. The housing having bending shoulders between the wire channels and the terminal channels. The wires are bent around the bending shoulders to transition from the terminal channels to the wire channels. The electrical connector includes a wire dress cover coupled to the wire support. The wire dress cover includes an end wall and wire pushers extending from the end wall. The wire pushers bend the wires around the bending shoulders to load the wires into the wire channels. The wire pushers are received in the wire channels to hold the wires in the wire channels.

DETAILED DESCRIPTION OF THE INVENTION

Figure 1:
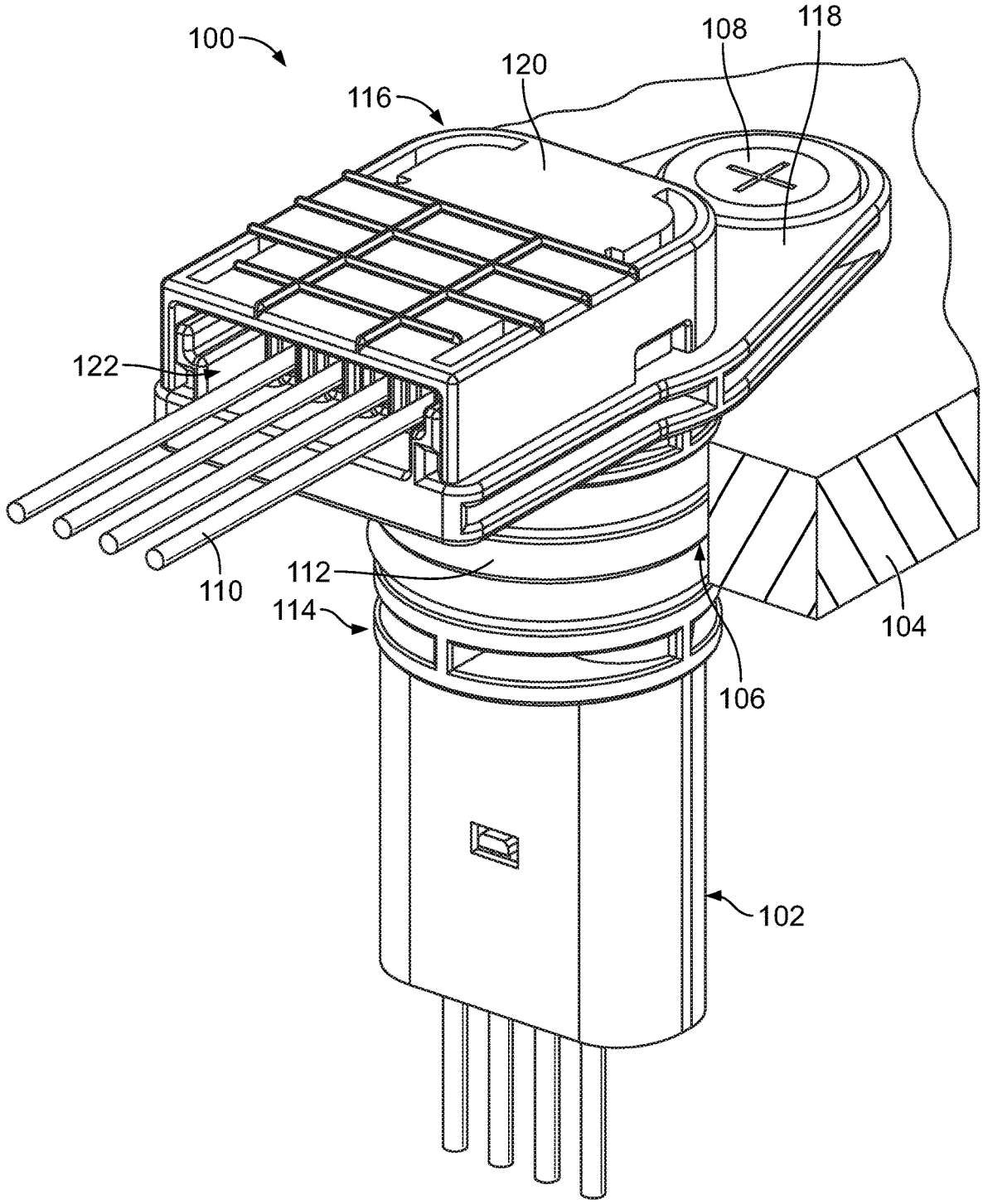
FIG. 1 is a rear perspective view of an electrical connector in accordance with an exemplary embodiment.

FIG. 1 is a rear perspective view of an electrical connector 100 in accordance with an exemplary embodiment. FIG. 1 illustrates the electrical connector 100 mated with a mating electrical connector 102. FIG. 1 illustrates the electrical connector 100 mounted to a panel 104 or other structure. The electrical connector 100 passes through an opening 106 in the panel 104. The electrical connector 100 is mounted to the panel 104 using a fastener 108, such as a screw. A portion of the electrical connector 100 is located behind the panel 104 and a portion of the electrical connector 100 extends forward of the panel 104 for mating with the mating electrical connector 102. In alternative embodiments, the electrical connector 100 may be mated to the mating electrical connector 102 independent of the panel 104. In the illustrated embodiment, the electrical connector 100 is a right angle connector. For example, wires 110 extending from the electrical connector 100 extend generally perpendicular to a mating direction of the mating electrical connector 102 with the electrical connector 100.

In an exemplary embodiment, the electrical connector 100 includes a housing 112 having a mating end 114 and a wire end 116 opposite the mating end 114. The wires 110 extend from the housing 112 at the wire end 116. The mating end 114 is configured to be mated with the mating electrical connector 102. The wire end 116 is located rearward of the panel 104. The mating end 114 extends forward of the panel 104. The housing 112 includes a base 118 at the wire end 116. The base 118 is mounted to the panel 104.

In an exemplary embodiment, the electrical connector 100 includes a wire dress cover 120 coupled to the housing 112. The wire dress cover 120 covers the wires 110 at the wire end 116. In an exemplary embodiment, the wire dress cover 120 provides strain relief for the wires 110. In an exemplary embodiment, the wire dress cover 120 is used for loading the wires 110 into a wire support 122 of the housing 112. For example, as the wire dress cover 120 is coupled to the wire support 122, the wire dress cover 120 engages each of the wires 110 and loads each of the wires 110 into the wire support 122. For example, the wire dress cover 120 may bend the wires 110 into the wire support 122 as the wire dress cover 120 is slidably coupled to the wire support 122.

Figure 2:
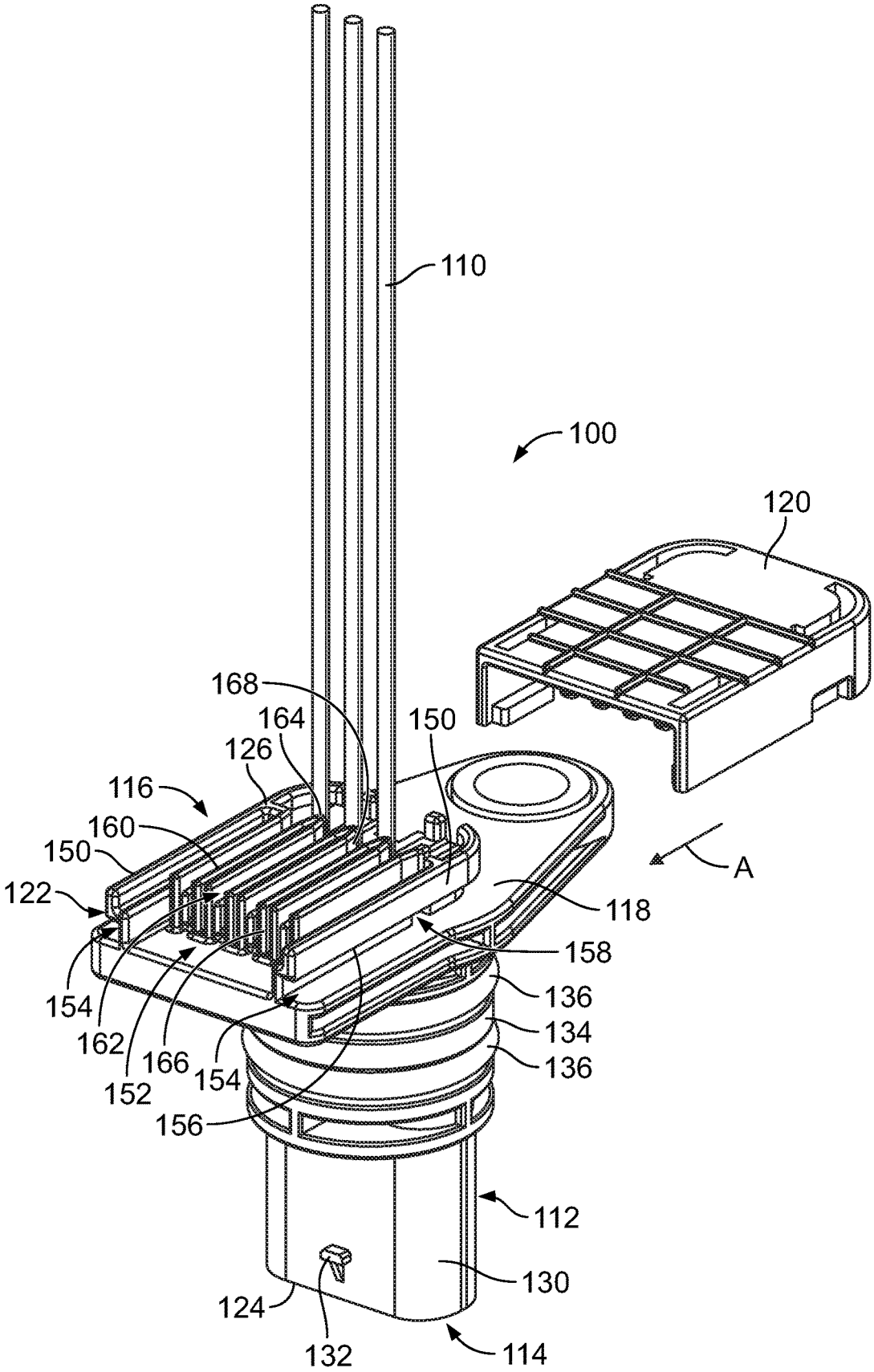
FIG. 2 is a rear perspective view of the electrical connector in accordance with an exemplary embodiment showing a wire dress cover uncoupled from a housing of the electrical connector.
Figure 3:
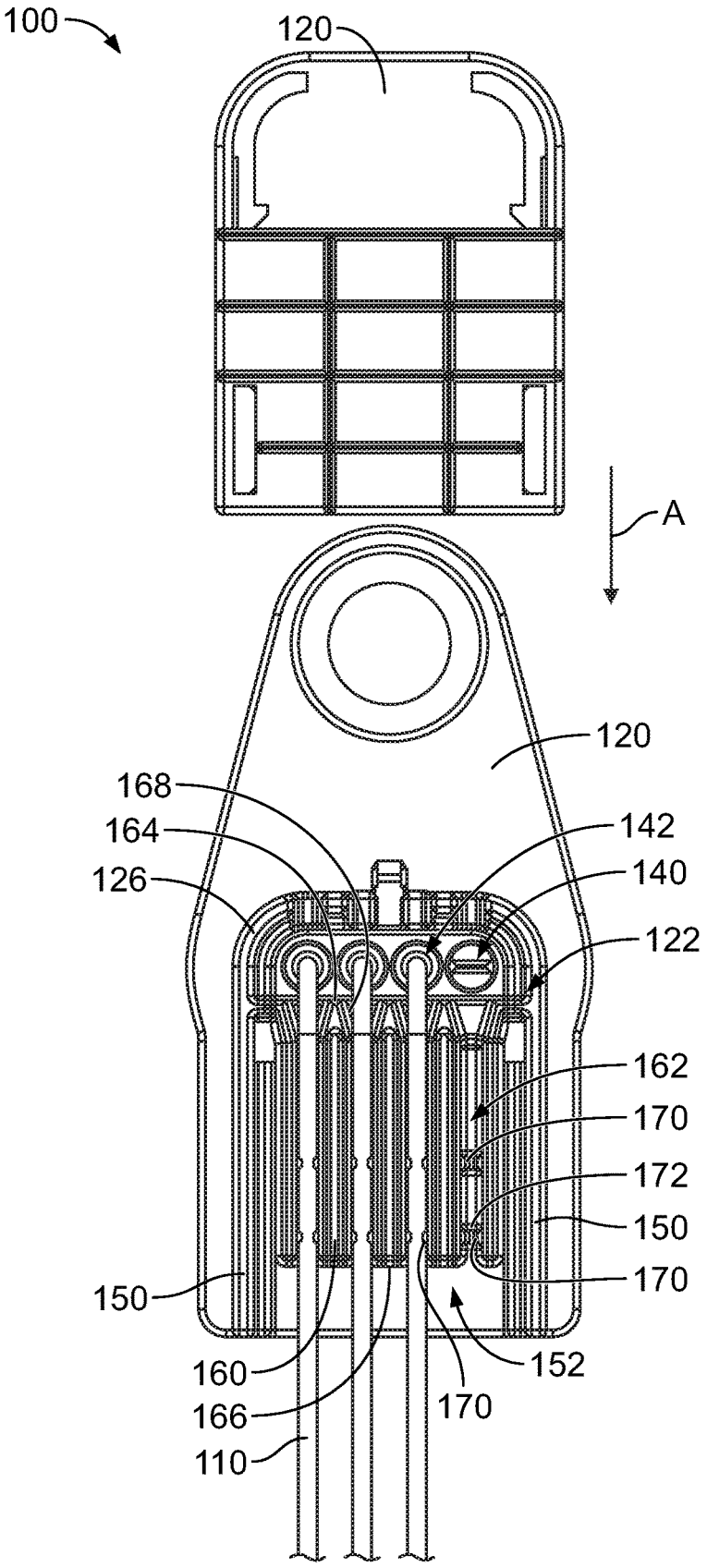
FIG. 3 is a top view of the electrical connector in accordance with an exemplary embodiment showing the wire dress cover uncoupled from the housing.

FIG. 2 is a rear perspective view of the electrical connector 100 in accordance with an exemplary embodiment showing the wire dress cover 120 uncoupled from the housing 112. FIG. 3 is a top view of the electrical connector 100 in accordance with an exemplary embodiment showing the wire dress cover 120 uncoupled from the housing 112.

As shown in FIG. 2, the housing 112 extends between a front 124 and a rear 126. The wire end 116 is provided at the rear 126. The base 118 and the wire support 122 are located at the rear 126 of the housing 112. The wires 110 extend from the housing 112 at the wire end 116. The mating end 114 is provided at the front 124. For example, the housing 112 includes a plug 130 at the front 124 configured to be plugged into the mating electrical connector 102 when mated thereto. Optionally, the housing 112 includes a connector latch 132 at the plug 130 for securing the mating electrical connector 102 to the electrical connector 100. The housing 112 includes a main body 134 between the plug 130 and the base 118. The main body 134 is configured to pass through the panel 104 (shown in FIG. 1). In the illustrated embodiment, the main body 134 is generally cylindrical. The main body 134 may have other shapes in alternative embodiments. In an exemplary embodiment, the electrical connector 100 includes seals 136 at the main body 134. For example, the seals 136 may be O-rings or other types of seals. The seals 136 are configured to be sealed to the panel 104.

In an exemplary embodiment, the housing 112 includes terminal channels 140 (FIG. 3) configured to receive terminals 142 (shown in FIG. 5) provided at ends of the wires 110. One of the terminals 142 and corresponding wires 110 are removed in FIGS. 2 and 3 to illustrate the terminal channel 140 and features of the wire support 122. The terminal channels 140 extend through the base 118, through the main body 134 into the plug 130. The terminal channels 140 are open at the rear 126 to receive the terminal 142 and the wire 110. The terminal channels 140 are open at the front 124 for mating the terminal 142 with the mating electrical connector 102. The terminal channels 140 extend generally parallel to the mating axis for mating the electrical connector 100 with the electrical connector 102.

The wire support 122 extends from the base 118 and is provided at the rear 126 of the housing 112. The wire dress cover 120 is configured to be slidably coupled to the wire support 122 to cover the wires 110. The wire dress cover 120 is configured to load the wires 110 into the wire support 122 when the wire dress cover 120 is slidably coupled to the wire support 122. In an exemplary embodiment, the wire dress cover 120 is slidably coupled to the wire support 122 in a sliding direction (shown by Arrow A), which is generally perpendicular to the mating axis.

The wire support 122 includes sidewalls 150 that define a cavity 152 rearward of the base 118. The sidewalls 150 include grooves 154 (FIG. 2) defined between the base 118 and a ledge 156 (FIG. 2) of the sidewall 150. The grooves 154 receive the locating features of the wire dress cover 120 to locate and secure the wire dress cover 120 to the wire support 122. In an exemplary embodiment, the grooves 154 extend parallel to each other along outer surfaces of the sidewalls 150. In an exemplary embodiment, the sidewalls 150 include latching features 158 for latchably securing the wire dress cover 120 to the wire support 122. In the illustrated embodiment, the latching features 158 are openings configured to receive latches of the wire dress cover 120. Other types of latching features may be used in alternative embodiments, such as deflectable latches along the sidewalls 150.

The wire support 122 includes support walls 160 extending from the base 118. The support walls 160 form wire channels 162 that receive corresponding wires 110. The wire channels 162 are defined between the support walls 160 and are open at the rear 126. The wire channels 162 are open at a first end 164 and a second end 166. The wire channels 162 are aligned with corresponding terminal channels 140 such that the wires 110 may be bent or pushed over by the wire dress cover 120 directly into the wire channels 162 from the terminal channels 140 as the wire dress cover 120 is coupled to the wire support 122. In an exemplary embodiment, the support walls 160 include rounded or chamfered lead-ins 168 at the first ends 164 of the wire channels 162. The chamfered lead-ins 168 open the wire channels 162 to the terminal channels 140. In an exemplary embodiment, the chamfered lead-ins 168 open the wire channels 162 at the first ends 164 of the wire channels 162 to provide larger gathering or catch areas for loading the wires 110 into the wire channels 162. In another embodiment, the top surfaces of the support walls 160 are chamfered at the first end to allow the wires 110 to more easily slide into the wire channels 162 as the wires 110 are bent by the wire dress cover 120.

In an exemplary embodiment, the support walls 160 include wire interference protrusions 170 extending into the wire channels 162 to engage the wires 110 and hold the wires 110 in the wire channels 162 by an interference fit to provide strain relief for the wires 110 in the wire support 122. The wire interference protrusions 170 may be bumps extending from the support walls 160. Optionally, the wire interference protrusions 170 are aligned with each other on opposite sides of the wire channels 162. In alternative embodiments, the wire interference protrusions 170 may be offset from each other forcing the wires 110 to follow a serpentine path through the wire channels 162 to provide strain relief for the wires 110. In an exemplary embodiment, the wire support 122 includes wire interference protrusions 172 extending from the base 118 into the wire channels 162 to engage the wires 110 and hold the wires 110 in the wire channels 162 by an interference fit between the wire interference protrusions 172 and the wire dress cover 120.

Figure 4:
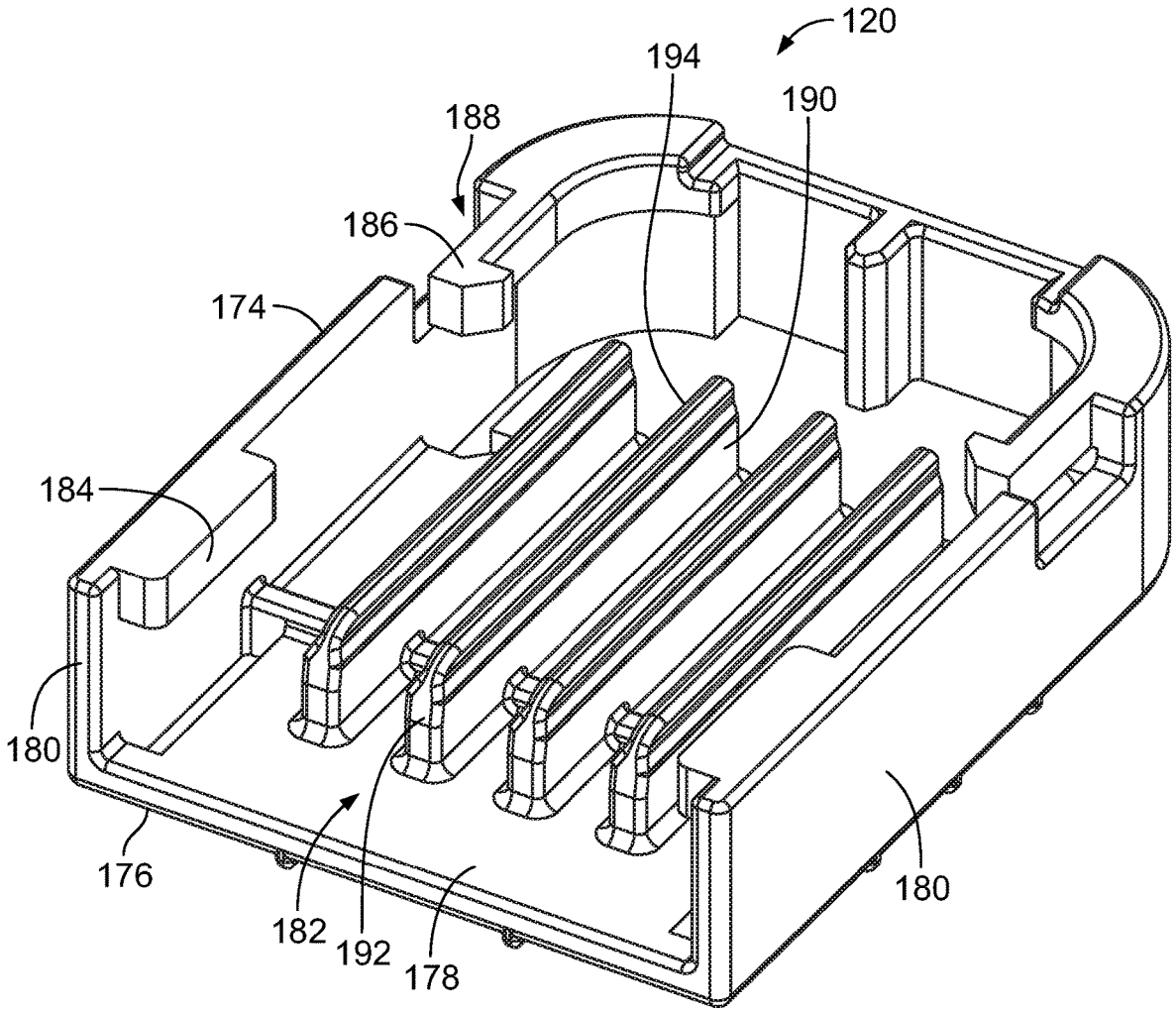
FIG. 4 is a front perspective view of the wire dress cover in accordance with an exemplary embodiment.

FIG. 4 is a front perspective view of the wire dress cover 120 in accordance with an exemplary embodiment. The wire dress cover 120 extends between a front 174 and a rear 176. The wire dress cover 120 includes an end wall 178 at the rear 176. The wire dress cover 120 includes sidewalls 180 extending from the end wall 178 to the front 174. A cavity 182 is defined between the sidewalls 180. The end wall 178 extends along the rear of the cavity 182. The cavity 182 is configured to receive the wires 110 (shown in FIG. 1).

In an exemplary embodiment, the sidewalls 180 include tabs 184 extending into the cavity 182. The tabs 184 are provided at the front 174 in the illustrated embodiment. The tabs 184 are configured to be received in the grooves 154 (shown in FIG. 2) to secure the wire dress cover 120 to the wire support 122 (shown in FIG. 2). In an exemplary embodiment, the sidewalls 180 include latches 186 used to secure the wire dress cover 120 to the wire support 122. The latches 186 are deflectable latches. Optionally, the sidewalls 180 may include relief pockets 188 to allow deflection of the latches 186.

In an exemplary embodiment, the wire dress cover 120 includes wire pushers 190 extending from the end wall 178 into the cavity 182. The wire pushers 190 are configured to engage and load the wires 110 into the wire channels 162 (shown in FIG. 2) as the wire dress cover 120 is being coupled to the wire support 122. The wire pushers 190 are configured to be received in the wire channels 162 to hold the wires 110 in the wire channels 162 to provide strain relief for the wires 110. Each wire pusher 190 includes a nose 192 at an end of the wire pusher 190 that extends from the end wall 178 to an inner edge 194 of the wire pusher 190. The inner edge 194 is forward facing and is configured to engage the wire 110 to hold the wire 110 in the wire channel 162. Optionally, the wire pusher 190 may have a curved corner at the intersection between the nose 192 and the inner edge 194. The curved corner of the nose 192 is configured to engage the wire 110 and push the wire 110 into the wire channel 162 as the wire dress cover 120 is being coupled to the wire support 122. The wire pushers 190 may have other shapes in alternative embodiments. Optionally, the wire pushers 190 may include wire interference protrusions (not shown) along the inner edge 194 to engage the wires 110.

Figure 5:
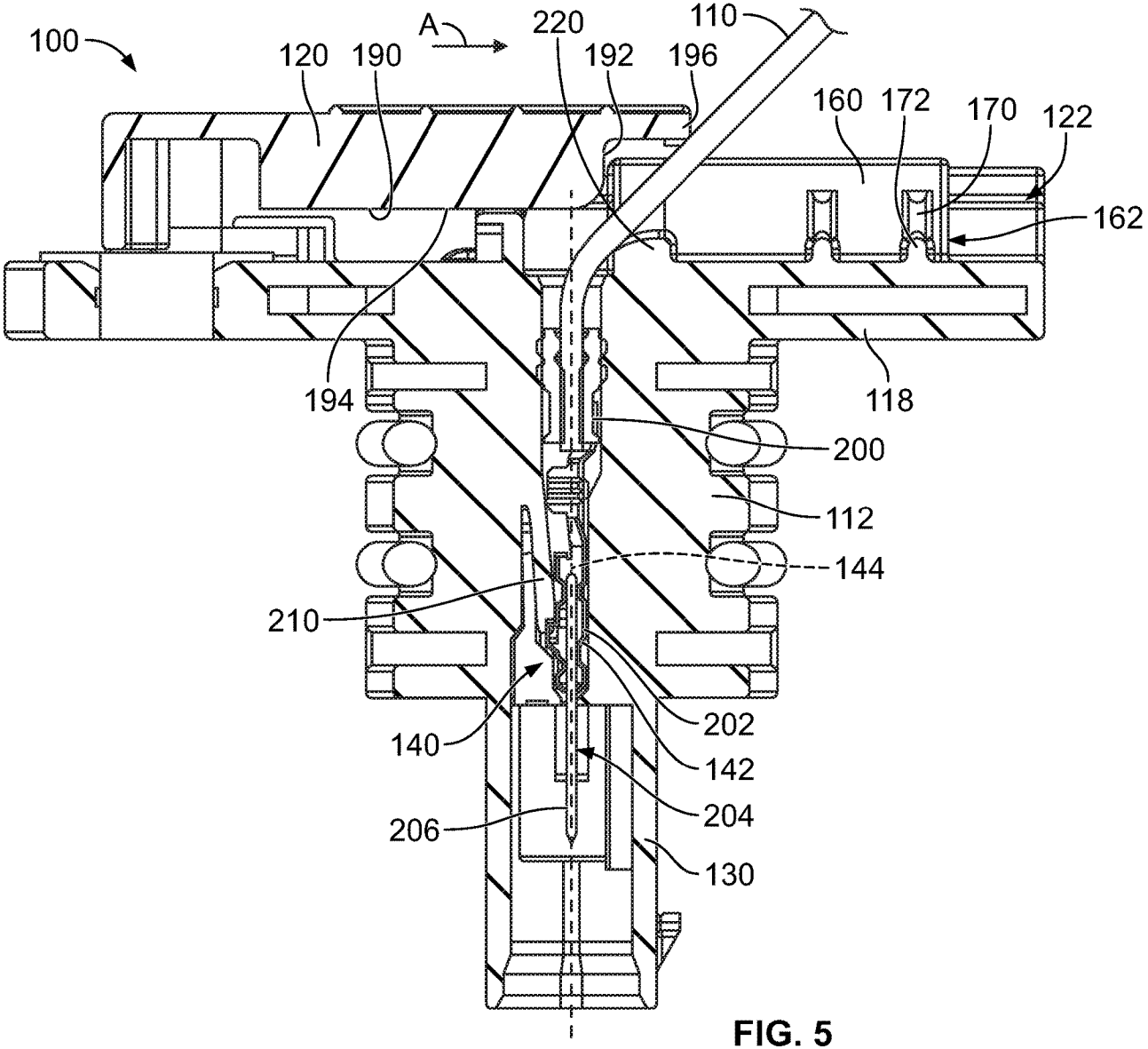
FIG. 5 is a cross-sectional view of the electrical connector in accordance with an exemplary embodiment showing the wire dress cover uncoupled from the housing.
Figure 6:
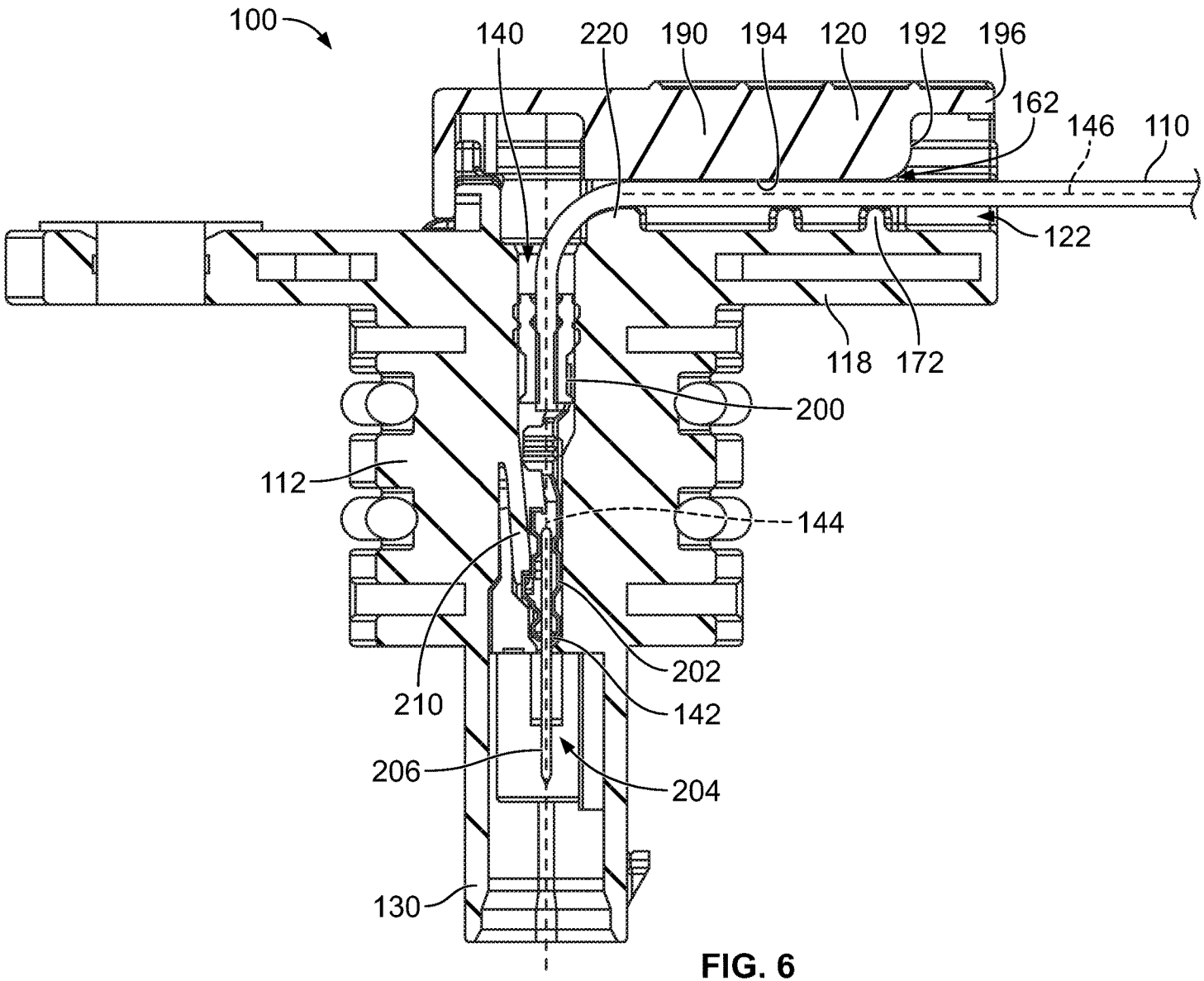
FIG. 6 is a cross-sectional view of the electrical connector in accordance with an exemplary embodiment showing the wire dress cover coupled to the housing.

FIG. 5 is a cross-sectional view of the electrical connector 100 in accordance with an exemplary embodiment showing the wire dress cover 120 in an uncoupled position. FIG. 6 is a cross-sectional view of the electrical connector 100 in accordance with an exemplary embodiment showing the wire dress cover 120 in a coupled position. The wire dress cover 120 is slidable along the base 118 and the wire support 122 from the uncoupled position (FIG. 5) to the coupled position (FIG. 6). The wire dress cover 120 is slidable in the sliding direction (Arrow A), which is perpendicular to terminal axes 144 of the terminal channels 140. The wires 110 initially extend from the terminals 142 along the terminal axes 144 and are transitioned toward a right angle bend along wire axes 146 that are perpendicular to the terminal axes 144. When the wire dress cover 120 is in the coupled position, the wires 110 extend from the wire support 122 along the wire axes 146.

The wires 110 are terminated to the terminals 142. In the illustrated embodiment, the terminal 142 includes a crimp barrel 200 at a terminating end of the terminal 142. The crimp barrel 200 is crimped to the wire 110 to mechanically and electrically connect the wire 110 to the terminal 142. The wire 110 may be connected to the terminal 142 by other means in alternative embodiments, such as being soldered or press-fit into an insulation displacement contact at the terminating end of the terminal 142. The terminal 142 includes a terminal body 202 extending from the crimp barrel 200 to a mating end 204 of the terminal 142. In the illustrated embodiment, the terminal 142 includes a pin 206 at the mating end 204. However, other types of mating interfaces may be provided at the mating end 204, such as a socket, a spring beam, a spring loaded pin, or another type of mating interface. The terminal 142 extends into the plug 130 for mating with the mating electrical connector 102 (shown in FIG. 1). In an exemplary embodiment, the housing 112 includes a latch 210 extending into the terminal channel 140 to engage the terminal body 202. The latch 210 secures the terminal 142 in the terminal channel 140.

In an exemplary embodiment, the housing 112 includes a bending shoulder 220 at the transition between the terminal channel 140 and the wire channel 162. The wire 110 is configured to be bent around the bending shoulder 220 to transition from the terminal channel 140 to the wire channel 162. The bending shoulder 220 is curved to control the bending of the wire 110 to ensure that the wire 110 is not bent beyond a bend limit of the wire 110. The bending shoulder 220 extends into the wire channel 162 between the support walls 160. In an exemplary embodiment, the wire 110 is supported in the wire channel 162 by the bending shoulder 220. The wire 110 may be held between the inner edge 194 of the wire pusher 190 and the bending shoulder 220 by an interference fit to provide strain relief for the wire 110 in the wire support 122. The wire 110 may be further engaged by the wire interference protrusions 170 along the support walls 160 and/or the wire interference protrusions 172 along the base 118. The wire interference protrusions 170 hold the wire 110 side-to-side by an interference fit to provide strain relief for the wire 110 in the wire support 122. The wire interference protrusions 172 cooperate with the inner edge 194 of the wire pusher 190 to hold the wire 110 front-to-rear by an interference fit to provide strain relief for the wire 110 and the wire support 122.

The wire dress cover 120 is slidably coupled to the wire support 122. The wire dress cover 120 slides along the rear of the base 118 to interface with the wire support 122. The wire dress cover 120 is slid between the uncoupled position (FIG. 5) and the coupled position (FIG. 6). As the wire dress cover 120 is slid along the wire support 122, the wire pusher 190 engages the wire 110 and bends the wire around the bending shoulder 220. Optionally, the wire dress cover 120 may include a cap 196 extending beyond the wire pusher 190. The cap 196 may engage the wire 110 to start pushing or bending the wire 110 as the wire dress cover 120 is moved from the uncoupled position to the coupled position. The nose 192 of the wire pusher 190 engages the wire 110 and pushes the wire 110 around the bending shoulder 220. The wire pusher 190 pushes the wire 110 into the wire channel 162. As the wire dress cover 120 is moved to the coupled position, the inner edge 194 of the wire pusher 190 engages the wire 110 and captures the wire 110 between the inner edge 194 and the bending shoulder 220 and/or the wire interference protrusions 172. The wire dress cover 120 and the wire support 122 provide strain relief for the wire 110.

Figure 7:
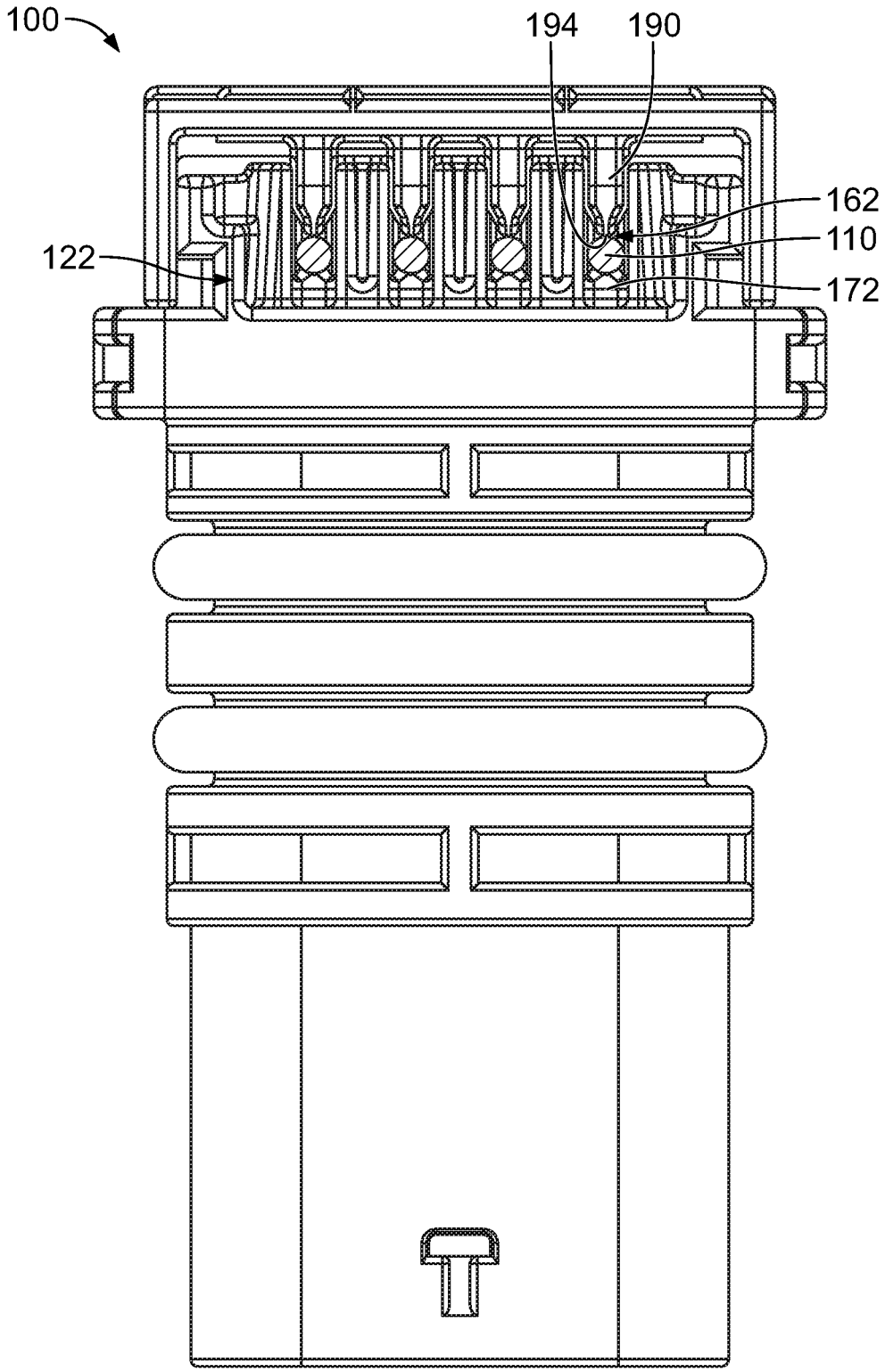
FIG. 7 is a side elevational view of the electrical connector in accordance with an exemplary embodiment.
Figure 8:
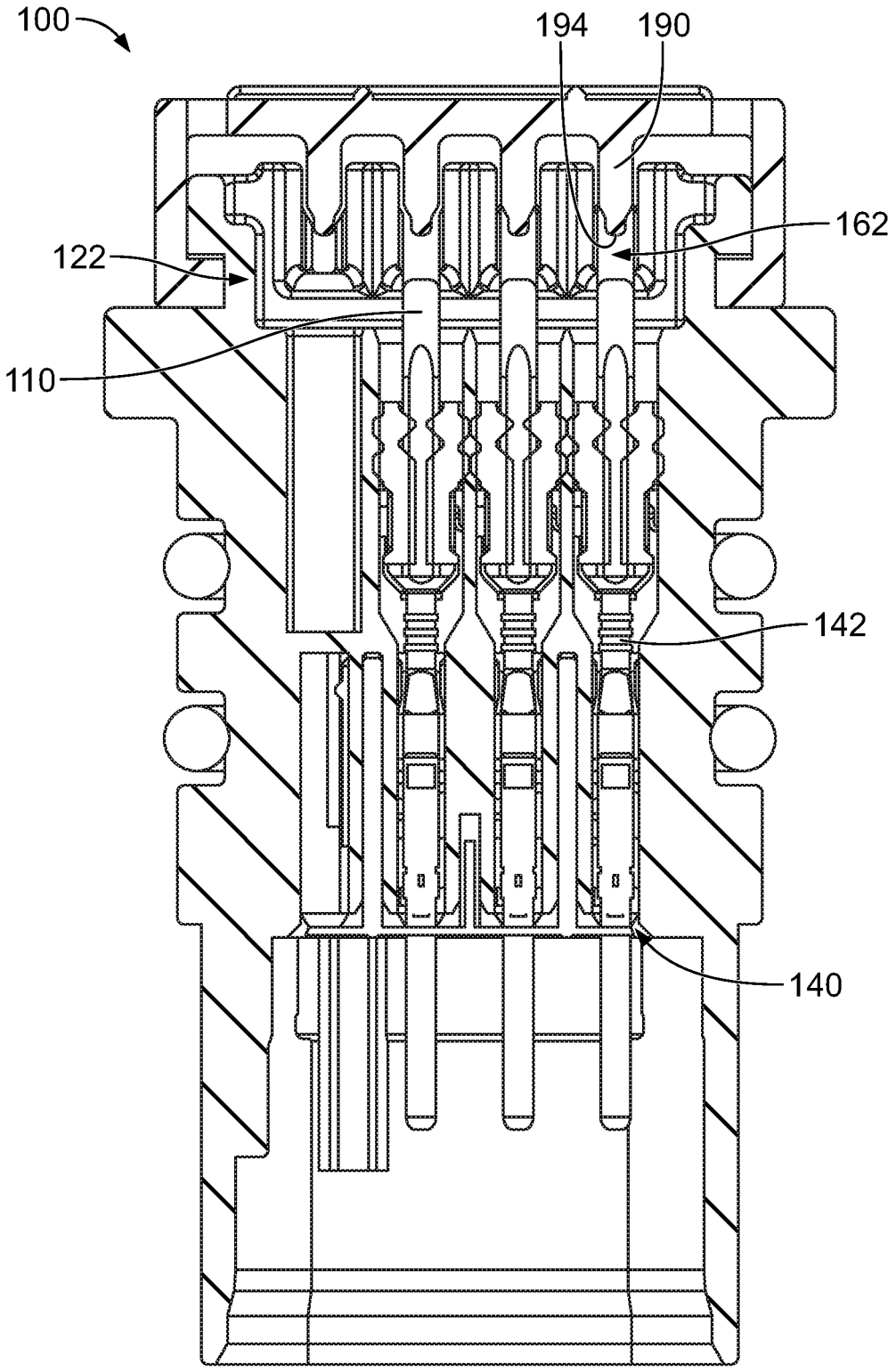
FIG. 8 is a side cross-sectional view of the electrical connector in accordance with an exemplary embodiment.

FIG. 7 is a side elevational view of the electrical connector 100 in accordance with an exemplary embodiment. As shown in FIG. 7, the wires 110 are held in the wire channels 162 by the wire pushers 190. The inner edges 194 engage the wires 110 and hold the wires 110 between the wire interference protrusions 172 and the inner edges 194. FIG. 8 is a side cross-sectional view of the electrical connector 100 in accordance with an exemplary embodiment. FIG. 8 illustrates the terminals 142 in the terminal channels 140. The wires 110 extend from the terminals 142 to the wire support 122. The wires 110 are directed into the wire channels 162.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing having a mating end at a front of the housing and a wire end at a rear of the housing, the housing having a base at the wire end, the housing having terminal channels extending through the base into the mating end, the terminal channels receiving terminals configured to be mated with a mating electrical connector, the base having a wire support supporting wires extending from the terminals, the wire support including support walls forming wire channels; and wherein the wire channels extend perpendicular to the terminal channels, the wires transitioning through a right angle bend between the terminal channels and the wire channels a wire dress cover coupled to the wire support, the wire dress cover including an end wall and wire pushers extending from the end wall, the wire pushers loading the wires into the wire channels, the wire pushers being received in the wire channels to hold the wires in the wire channels;

wherein the wires are supported at the rear by the wire pushers and at both sides by the support walls to provide strain relief for the wires in the wire support.

2. The electrical connector of claim 1, wherein the wire pushers engage each of the wires to push each of the wires into the wire channels as the wire dress cover is coupled to the wire support.

3. The electrical connector of claim 1, wherein the wire dress cover is slidably coupled to the wire support, the wire dress cover moving between an uncoupled position and a coupled position, the wire dress cover pushing the wires into the wire channels as the wire dress cover is moved from the uncoupled position to the coupled position.

4. The electrical connector of claim 1, wherein the housing includes bending shoulders between the terminal channels and the wire channels, the wire dress cover bending the wires along the bending shoulders to load the wires into the wire channels.

5. The electrical connector of claim 1, wherein the wire support includes sidewalls on opposite sides of the support walls, the sidewalls of the wire support including grooves, the wire dress cover including side walls extending from the end wall, the sidewalls of the wire dress cover including tabs, the tabs being slidably received in the grooves to secure the wire dress cover to the wire support.

6. The electrical connector of claim 1, wherein the support walls include chamfered lead-in surfaces to the wire channels.

7. The electrical connector of claim 1, wherein the support walls include wire interference protrusions extending into the wire channels to engage the wires and hold the wires in the wire channels by an interference fit to provide strain relief for the wires in the wire support.

8. The electrical connector of claim 1, wherein each wire pusher includes an inner edge opposite the end wall, the wires being held in the wire channels by an interference fit between the inner edges of the wire pushers and the wire support to provide strain relief for the wires in the wire support.

9. The electrical connector of claim 8, wherein the base includes wire interference protrusions extending into the wire channels between the support walls, the wires being pinched between the inner edges of the wire pushers and the wire interference protrusions.

10. The electrical connector of claim 1, wherein each wire pusher includes a nose at a first end of the wire pusher, the nose extending between the end wall and an inner edge of the corresponding wire pusher, the nose engaging the wire and forcing the wire into the wire channel as the wire dress cover is coupled to the wire support.

11. The electrical connector of claim 1, wherein all of the wires are simultaneously pushed into the wire channels by the wire pushers as the wire dress cover is coupled to the wire support.

12. An electrical connector comprising:

a housing having a mating end at a front of the housing and a wire end at a rear of the housing, the housing having a base at the wire end, the housing having terminal channels extending through the base into the mating end along terminal channel axes, the terminal channels receiving terminals configured to be mated with a mating electrical connector, the base having a wire support supporting wires extending from the terminals, the wire support including support walls forming wire channels; and a wire dress cover slidably coupled to the wire support in a sliding direction generally perpendicular to the terminal channel axes, the wire dress cover movable in the sliding direction from an uncoupled position to a coupled position, the wire dress cover including an end wall and wire pushers extending from the end wall, the wire pushers extending parallel to the sliding direction, the wire pushers engaging each of the wires and loading each of the wires into the wire channels as the wire dress cover is moved from the uncoupled position to the coupled position, the wire pushers being received in the wire channels to hold the wires in the wire channels.

13. The electrical connector of claim 12, wherein all of the wires are simultaneously pushed into the wire channels by the wire pushers as the wire dress cover is slidably coupled to the wire support.

14. The electrical connector of claim 12, wherein the housing includes bending shoulders between the terminal channels and the wire channels, the wire dress cover bending the wires along the bending shoulders to load the wires into the wire channels.

15. The electrical connector of claim 12, wherein the wire support includes sidewalls on opposite sides of the support walls, the sidewalls of the wire support including grooves, the wire dress cover including side walls extending from the end wall, the sidewalls of the wire dress cover including tabs, the tabs being slidably received in the grooves to secure the wire dress cover to the wire support.

16. The electrical connector of claim 12, wherein the support walls include wire interference protrusions extending into the wire channels to engage the wires and hold the wires in the wire channels by an interference fit to provide strain relief for the wires in the wire support, each wire pusher including an inner edge opposite the end wall, the wires being held in the wire channels by an interference fit between the inner edges of the wire pushers and the wire support to provide strain relief for the wires in the wire support.

17. An electrical connector comprising:

a housing having a mating end at a front of the housing and a wire end at a rear of the housing, the housing having a base at the wire end, the housing having terminal channels extending through the base into the mating end, the terminal channels receiving terminals configured to be mated with a mating electrical connector, the base having a wire support supporting wires extending from the terminals, the wire support including support walls forming wire channels, the housing having bending shoulders between the wire channels and the terminal channels, the wires being bent around the bending shoulders to transition from the terminal channels to the wire channels; and a wire dress cover coupled to the wire support, the wire dress cover including an end wall and wire pushers extending from the end wall, the wire pushers bending the wires around the bending shoulders to load the wires into the wire channels, the wire pushers being received in the wire channels to hold the wires in the wire channels.

18. The electrical connector of claim 17, wherein the wire dress cover is slidably coupled to the wire support, the wire dress cover moving between an uncoupled position and a coupled position, the wire dress cover simultaneously pushing all of the wires into the wire channels as the wire dress cover is moved from the uncoupled position to the coupled position.

19. The electrical connector of claim 17, wherein the support walls include wire interference protrusions extending into the wire channels to engage the wires and hold the wires in the wire channels by an interference fit to provide strain relief for the wires in the wire support, each wire pusher including an inner edge opposite the end wall, the wires being held in the wire channels by an interference fit between the inner edges of the wire pushers and the wire support to provide strain relief for the wires in the wire support.

* * * * *